US012397204B1

(12) United States Patent
Hobbs et al.

(10) Patent No.: US 12,397,204 B1
(45) **Date of Patent: *Aug. 26, 2025**

(54) IRON-TYPE GOLF CLUB HEAD

(71) Applicant: Cobra Golf Incorporated, Carlsbad, CA (US)

(72) Inventors: Bryce W. Hobbs, Escondido, CA (US); Ryan L. Roach, Encinitas, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/584,493

(22) Filed: Feb. 22, 2024

Related U.S. Application Data

(63) Continuation of application No. 17/344,245, filed on Jun. 10, 2021, now Pat. No. 11,980,796, which is a continuation of application No. 16/788,898, filed on Feb. 12, 2020, now Pat. No. 11,033,788.

(51) Int. Cl.
*A63B 53/04* (2015.01)

(52) U.S. Cl.
CPC ..... *A63B 53/0475* (2013.01); *A63B 53/0416* (2020.08); *A63B 2053/0491* (2013.01)

(58) Field of Classification Search
CPC ..... A63B 53/0475; A63B 53/0416; A63B 2053/0491; A63B 53/047; A63B 2053/0483
See application file for complete search history.

(56) References Cited

U.S. PATENT DOCUMENTS

| | | | | |
|---|---|---|---|---|
| 4,883,275 | A * | 11/1989 | Boone | A63B 60/52 473/335 |
| 6,533,679 | B1 * | 3/2003 | McCabe | A63B 60/02 473/335 |
| 6,899,636 | B2 * | 5/2005 | Finn | A63B 53/0487 473/341 |
| 9,770,635 | B2 * | 9/2017 | Motokawa | A63B 60/04 |
| 9,855,477 | B2 * | 1/2018 | Franklin | A63B 53/047 |
| 10,080,932 | B2 * | 9/2018 | DeMille | A63B 60/42 |
| 2008/0015050 | A1 * | 1/2008 | Tavares | A63B 53/047 473/346 |

* cited by examiner

*Primary Examiner* — Michael D Dennis
(74) *Attorney, Agent, or Firm* — Quarles & Brady LLP

(57) ABSTRACT

A golf club head includes a body having a toe region, a heel region, a sole weight bar extending between the toe region and the heel region, and a face insert that is coupled to the body and wraps about the sole weight bar. The golf club head defines a sole having a toe segment, a medial segment, and a heel segment, and the face insert at least partially defines the medial segment of the sole. A gap is disposed between the sole weight bar and the face insert. The gap extends entirely about an outer periphery of the sole weight bar and is disposed between the sole weight bar and each of a face portion of the face insert, a sole portion of the face insert, and a back portion of the medial segment of the sole.

20 Claims, 8 Drawing Sheets

IRON-TYPE GOLF CLUB HEAD

CROSS REFERENCE TO RELATED APPLICATIONS

This patent application is a continuation of U.S. patent application Ser. No. 17/344,245, filed on Jun. 10, 2021, which is a continuation of U.S. patent application Ser. No. 16/788,898, filed on Feb. 12, 2020, and now issued as United State U.S. Pat. No. 11,033,788, each of which is incorporated herein by reference in its entirety.

REFERENCE REGARDING FEDERALLY SPONSORED RESEARCH OR DEVELOPMENT

Not applicable.

SEQUENCE LISTING

Not applicable.

BACKGROUND

1. Field of the Disclosure

The present disclosure relates to golf clubs, and more specifically to an iron-type golf club head that includes a face insert.

2. Description of the Background of the Disclosure

Different types of golf clubs are used to effect different types of shots, based on a golfer's location and ball lie when playing a hole on a golf course. An iron is a golf club that is used to make a variety of shots on a golf hole, for example, approach shots, bunker shots, chips, etc.

Conventional iron-type golf club heads may include a face insert that is attached to a body. For example, a conventional face insert may be in the form of 2-D plate that is welded around the periphery of the insert to adjoin to the body. In some configurations, conventional face inserts may define a more complex geometry, such as cup faces and partial cup faces (e.g., L-cups) that are welded around the entire periphery of the insert to adjoin to the club head body. Generally, the complex geometry defined by conventional cup face inserts attempts to move the weld further away from the high stress areas of the face.

A major disadvantage of conventional cup faces is that a longer weld bead is required around the entire perimeter of the face insert, when joining it to the body, which increases club head weight and manufacturing time. In addition, conventional cup face inserts are welded to a portion on the sole of the club head body at a location that is at most only half of the width of the sole back from the front of the face (e.g., at most half of the way between a leading edge and a trailing edge). This creates an extremely stiff portion in the middle of the sole and prevents the face and sole from flexing.

Therefore, a need exists for an iron-type golf club head with an improved face insert design that provides more efficient manufacturability and increased performance.

SUMMARY

The present disclosure provides an iron-type golf club head that includes a body and a face insert. A topline and a sole of the iron-type golf club head are integrated into the face insert to reduce a welding perimeter distance, improve control over a thickness of the face insert, and maintain maximum flexibility in the face insert and the sole.

In some embodiments, the present disclosure provides a golf club head that includes a body having a toe region, a heel region, and a sole weight bar extending between the toe region and the heel region, a sole defining a toe segment, a medial segment, and a heel segment, and a face coupled to the body. A gap is arranged between the sole weight bar and a rear surface of the face. The gap extends around an outer periphery of the sole weight bar and is formed between the sole weight bar and the medial segment of the sole.

In some embodiments, the present disclosure provides a golf club head that includes a body having a toe portion, a heel portion, and a sole portion, a weight bar extending between the toe portion and the heel portion, and a face coupled to the body. A gap is arranged between the weight bar and the sole portion. The gap extends around an outer periphery of the weight bar and is formed between the weight bar and a rear surface of the face.

In some embodiments, the present disclosure provides a golf club head that includes a body having a toe region, a heel region, and a sole weight bar extending between the toe region and the heel region, a sole defining a medial segment, and a face insert coupled to the body at an interface between the face insert and the body and having a face portion. A gap is arranged between the sole weight bar and the face portion of the face insert. The gap extends around an outer periphery of the sole weight bar and is formed between the sole weight bar and the medial segment of the sole.

In some embodiments, the present disclosure provides a golf club head including a body with a toe region and a heel region, a sole weight bar extending between the toe region and the heel region, and a face insert that is coupled to the body and wraps about the sole weight bar. The golf club head defines a sole having a toe segment, a medial segment, and a heel segment, and the face insert at least partially defines the medial segment of the sole. A gap is disposed between the sole weight bar and the face insert. The gap extends entirely about an outer periphery of the sole weight bar and is disposed between the sole weight bar and each of a face portion of the face insert, a sole portion of the face insert, and a back portion of the medial segment of the sole.

In some embodiments, the present disclosure provides a golf club head including a body with a toe region and a heel region, a sole weight bar extending between the toe region and the heel region, and a face insert coupled to the body and including a face portion and a sole portion that wrap around the sole weight bar. A gap is disposed between the sole weight bar and the face insert. The gap extends entirely about an outer periphery of the sole weight bar and is disposed between the sole weight bar and each of the face portion, the sole portion, and a back portion of the body.

In some embodiments, the present disclosure provides a golf club head including a body with a toe region and a heel region, a sole weight bar extending between the toe region and the heel region, and a face insert coupled to the body at an interface between the face insert and the body. The golf club head defines a sole having a toe segment, a medial segment, and a heel segment, and the face insert includes a face portion and a sole portion that wrap around the sole weight bar. The sole portion at least partially defines the medial segment of the sole, and a gap is disposed between the sole weight bar and the face insert. The gap extends entirely about an outer periphery of the sole weight bar and is disposed between the sole weight bar and each of the face portion, the sole portion, and a back portion of the medial segment of the sole.

DETAILED DESCRIPTION OF THE DRAWINGS

Figure 1:
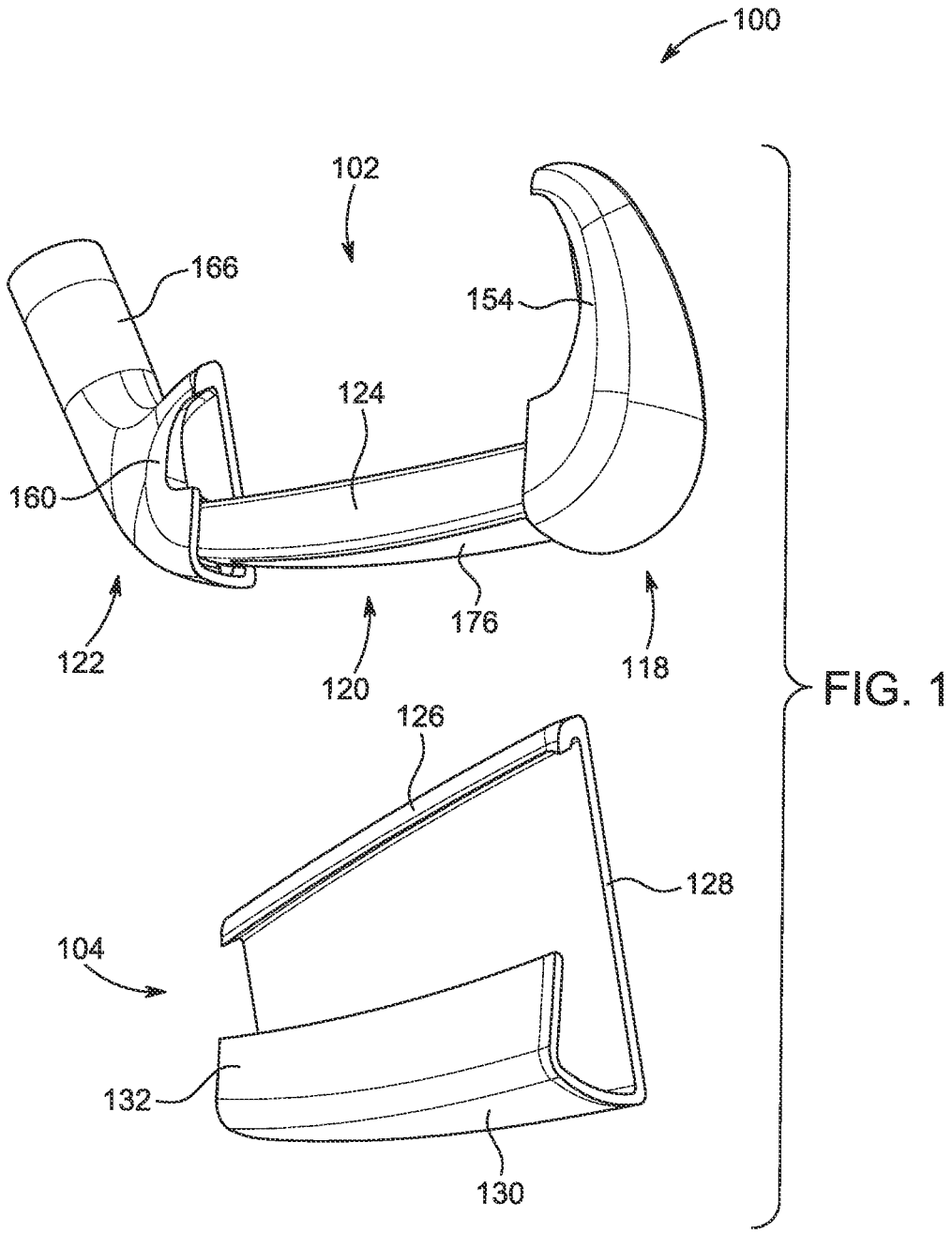
FIG. 1 is an exploded bottom, back, right isometric view of an iron-type golf club head according to the present disclosure.
Figure 2:
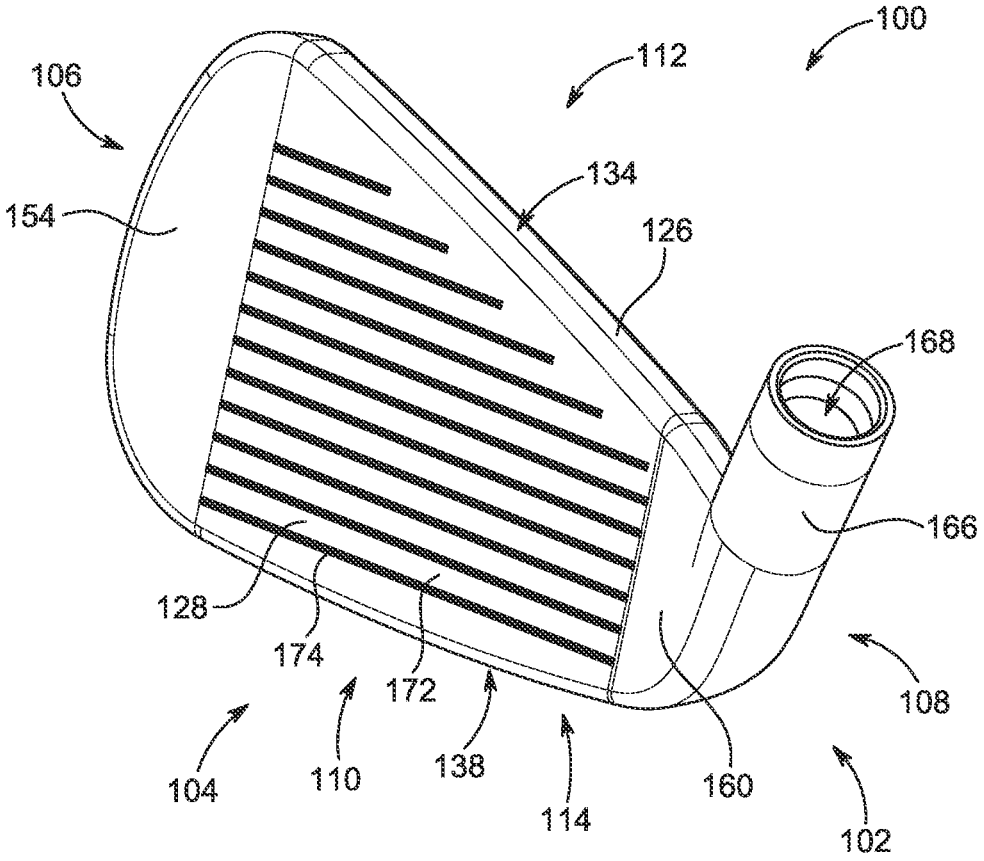
FIG. 2 is a top, front, left isometric view of the iron-type golf club head of FIG. 1 with a face insert coupled to a body.
Figure 3:
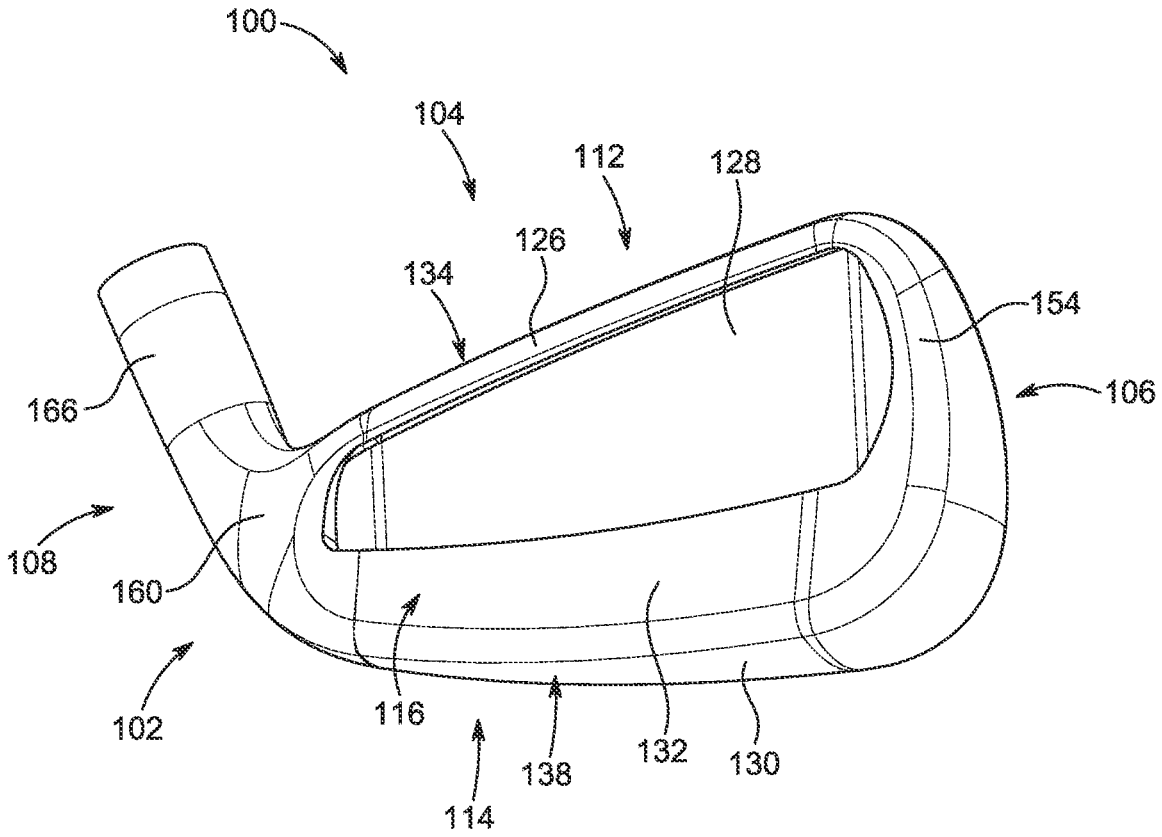
FIG. 3 is a bottom, back, right isometric view of the iron-type golf club head of FIG. 2.

The present disclosure is directed to an iron-type golf club head that is manufactured using a multi-piece design, and that includes a face insert attached to a body. In particular, an iron-type golf club head of the present disclosure includes a body and a face insert that is coupled to the body, and that does not require welding around its entire periphery. Unlike conventional face inserts, the sole and the topline of the club head may integrated into and formed by the face insert, which only requires welding along the interface between the body and the face insert. In particular, welding along the interface between the body and face insert may only occur in a sole-topline direction along the club head (e.g., a vertical direction when the sole is resting on the ground and the club is at address, or a direction generally perpendicular to a heel-toe direction). The lack of heel-toe direction welds required to couple the face insert to the body substantially reduces the length of the weld bead required during manufacturing, which, in turn, reduces a weight of the club head and improves manufacturing efficiency.

In addition, with the face insert defining the sole and only requiring sole-topline-extending welds to couple to the club head body, the welds are arranged away from impact locations on the face insert. In this way, for example, the thickness defined by the face insert may be controlled with tighter tolerances, especially in high stress areas on the face insert. Further, the iron-type golf club head according to the present disclosure may separate (e.g., form a gap between) a sole weight bar formed in the body and the sole formed by the face insert. This may provide a lower center of gravity (e.g., move the center of gravity in a direction toward the sole) and allow the highest possible amount of face and sole flex, which improves performance.

Referring now to FIGS. 1-5, an iron-type golf club head 100 is shown in accordance with the present disclosure. The iron-type golf club head 100 includes a body 102 and a face insert 104, which may be coupled to one another after machining of the body 102. In some embodiments, the face insert 104 may be manufactured from a different material than the body 102. For example, the body 102 and the face insert 104 may be manufactured from different metal materials.

The iron-type golf club head 100 defines a toe side 106, a heel side 108, a front side 110, a top side 112, a bottom side 114, and a rear side 116. The body 102 includes a toe region 118, a medial region 120, a heel region 122, and a sole weight bar 124 extending through the medial region 120 and between the toe region 118 and the heel region 122. The medial region 120 is arranged between the toe region 118 and the heel region 122. The sole weight bar 124 is arranged adjacent to the bottom side 114.

In general, the medial region 120 of the body 102 is devoid of material other than the sole weight bar 124 extending between the toe region 118 and the heel region 122. With the body 102 including only the sole weight bar 124 in the medial region 120, a club face, a sole, and a topline of the iron-type golf club head 100 in the medial region 120 may be defined entirely by the face insert 104 as will be described herein. The face insert 104 is designed to fit between the toe region 118 and the heel region 122 (e.g., the face insert 104 is arranged in the medial region 120) and fill at least a portion of the void therebetween.

In the illustrated embodiment, a portion of the face insert 104 is designed to extend or wrap around the sole weight bar 124. For example, the face insert 104 includes a top portion 126, a face portion 128, a sole portion 130, and a back portion 132. A section of the face portion 128, the sole portion 130, and the back portion 132 combine to form a generally U-shaped cavity that is designed to extend or wrap around the sole weight bar 124, when the face insert 104 is coupled to the body 102 (see, e.g., FIG. 6).

Referring to FIGS. 2-5, the iron-type golf club head 100 defines a topline 134 extending laterally in a heel-toe direction 136 along the top side 112, and a sole 138 extending laterally in the heel-toe direction 136 (see FIGS. 4 and 5) along the bottom side 114. The topline 134 includes a top-toe segment 140, a top-medial segment 142, and a top-heel segment 144. The top-medial segment 142 of the topline 134 extends along the medial region 120 and is formed by the top portion 126 of the face insert 104. That is, the portion of the topline 134 arranged within the medial region 120 is formed entirely by the top portion 126 of the face insert 104. This differs from conventional iron-type golf club heads with a face insert where the topline is typically formed by a combination of the body and the face insert, or solely by the body.

Similar to the topline 134, at least a portion of the sole 138 is formed entirely by the face insert 104. For example, the sole 138 includes a sole-toe segment 148, a sole-medial segment 150, and a sole-heel segment 152. The sole-medial segment 150 of the sole 138 extends along the medial region 120 and is formed by the sole portion 130 of the face insert 104. That is, the portion of the sole 138 arranged within the medial region 120 is formed entirely by the sole portion 130 of the face insert 104. This differs from conventional iron-type golf club heads with a face insert where the sole is typically formed by a combination of the body and the face insert, or solely by the body. For example, as described herein, conventional face inserts are typically welded to a portion on the sole of the body at a location that is at most only half of the width of the sole back from the front of the face. In other words, the sole of conventional iron-type golf club heads with a face insert is formed by the face insert from a leading edge (e.g., an edge of the sole adjacent to the front side) to a location at most only half of the way between the leading edge and a trailing edge (e.g., an edge of the sole adjacent to the back side). The remaining portion of the sole is formed by the body, for example, from the location at most only half of the way between the leading edge and the trailing edge to the trailing edge of the sole. Contrary to conventional iron-type golf club heads, the topline 134 and the sole 138 of the iron-type golf club head 100 are integrated into the face insert 104, which simplifies the manufacture of the iron-type golf club head 100 by only requiring welds in a sole-topline direction 146 at the interface between the body 102 and the face insert 104, thereby providing several performance benefits.

Figure 4:
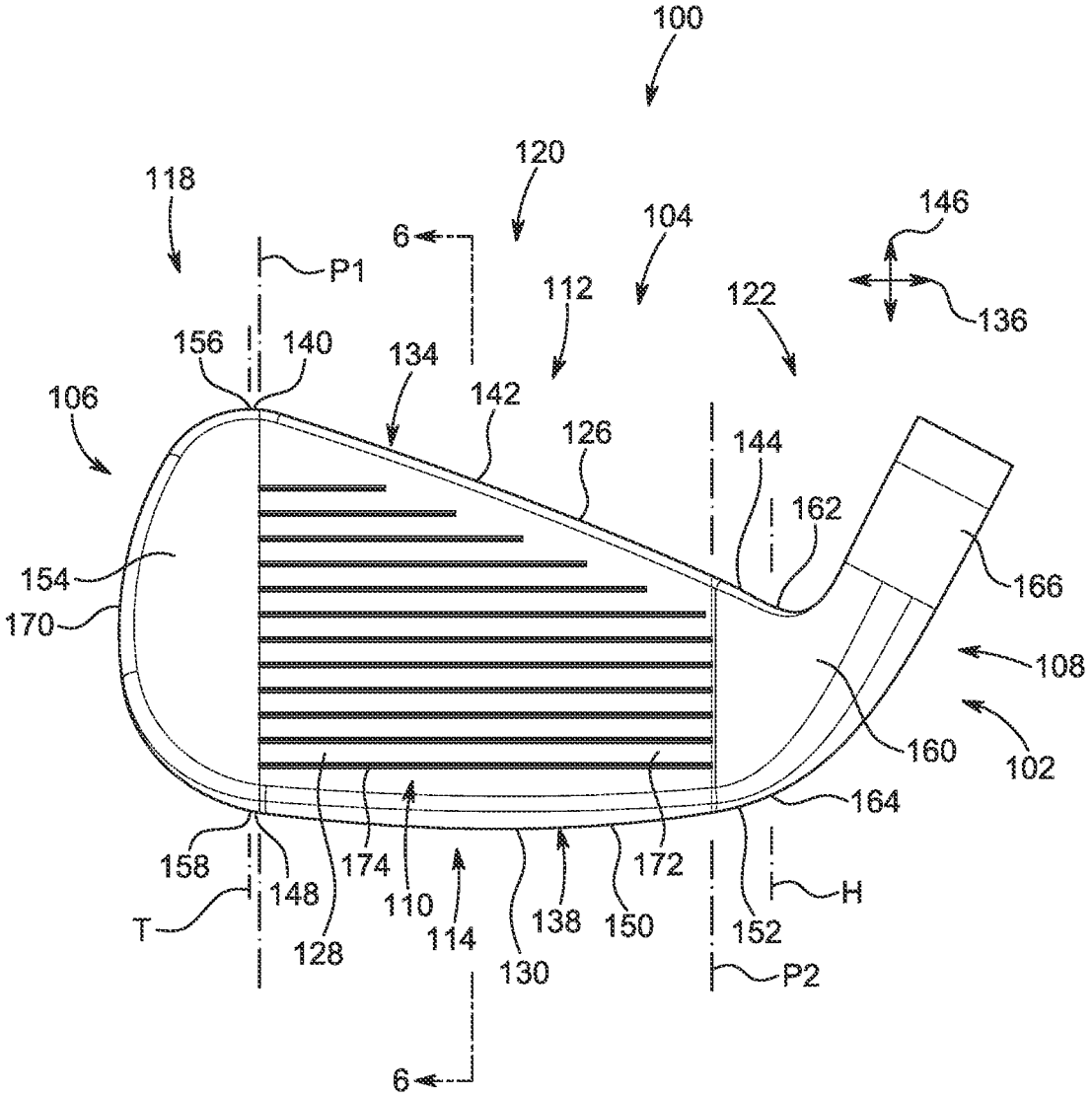
FIG. 4 is a front view of the iron-type golf club head of FIG. 2.
Figure 5:
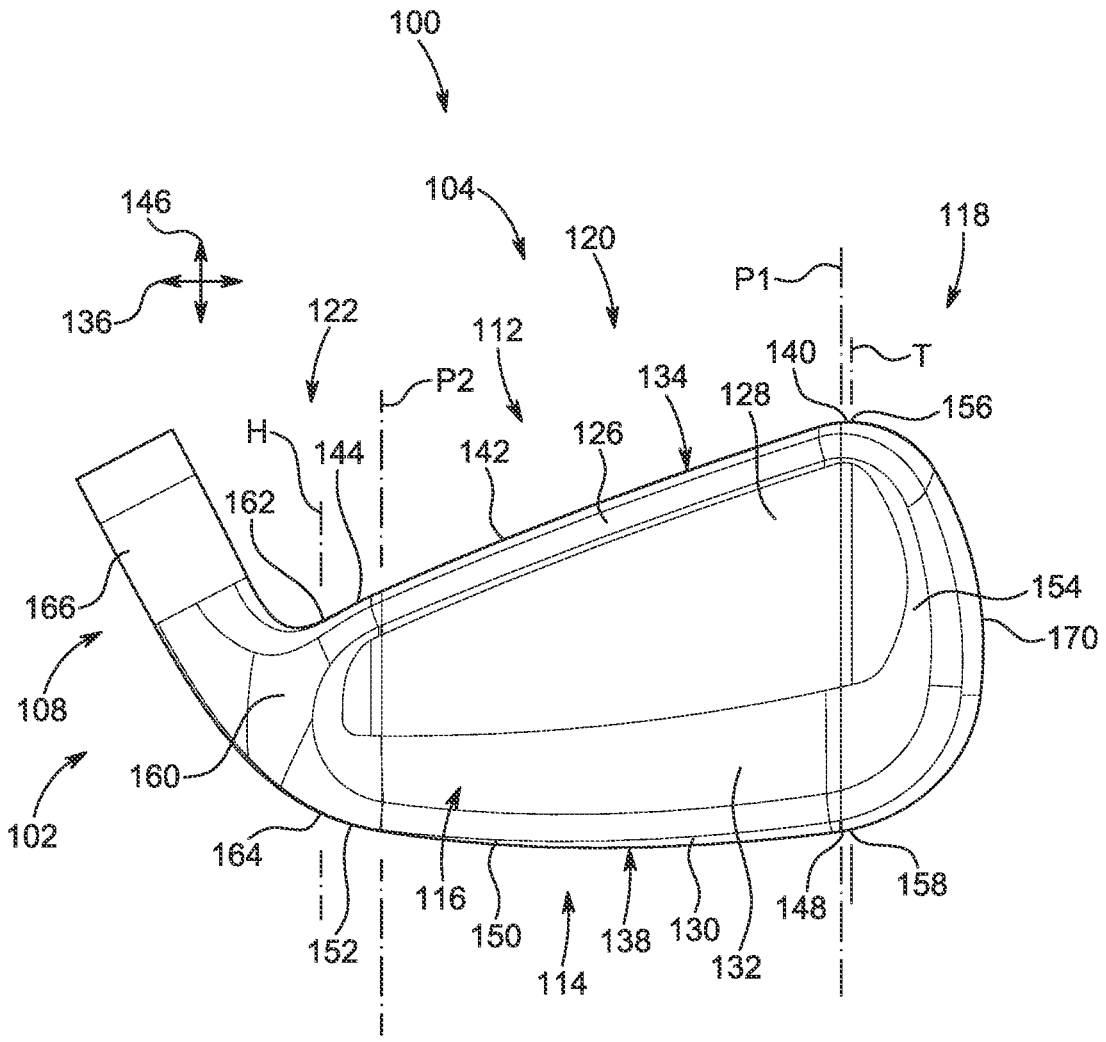
FIG. 5 is a back view of the iron-type golf club head of FIG. 2.

Referring specifically to FIGS. 4 and 5, the toe region 118, the medial region 120, and the heel region 122 are defined by lines or planes P1 and P2 that extend through the iron-type golf club head 100 at an interface between the face insert 104 and the laterally-inner edges of the body 102. As illustrated in FIGS. 4 and 5, the toe region 118 and the heel region 122 are arranged at laterally-opposing ends of the body 102, and the medial region 120 is arranged laterally between the toe region 118 and the heel region 122.

The toe region 118 includes a toe portion 154 of the body 102 that is defined by a portion of the body 102 between a distal end of the toe side 106 and the plane P1. A toe plane T may intersect the top side 112 of the toe portion 154 at a toe-topline intersection point 156 along the topline 134 where the slope of a line tangent to the topline 134 is approximately zero (e.g., a point where a line tangent to the periphery of the top side 112 is approximately parallel to the ground at address). The toe plane T extends through the toe portion 154 in the sole-topline direction 146 (e.g., a vertical direction from the perspective of FIGS. 4 and 5) to a toe-sole intersection point 158.

The heel region 122 includes a heel portion 160 of the body 102 that is defined by a portion of the body 102 between a distal end of the heel side 108 and the plane P2. The heel plane H may intersect the top side 112 at a heel-topline inflection point 162 (e.g., a point where the periphery of the top side 112 transitions from concave down to concave up). The heel plane H extends through the heel portion 160 in the sole-topline direction 146 (e.g., a vertical direction from the perspective of FIGS. 4 and 5) to a heel-sole intersection point 164. The heel portion 160 includes a hosel 166 that extends from the heel portion 160 at an angle (e.g., a lie angle) in a direction away from the toe portion 154. The hosel 166 defines a hosel cavity 168 within which a shaft (not shown) may be inserted for coupling to the iron-type golf club head 100. In some embodiments, a ferrule (not shown) may abut or be at least partially inserted into the hosel 166.

The topline 134 may extend along an outer periphery of the top side 112 from the heel-topline inflection point 162, along the top portion 126 of the face insert 104, to the toe-topline intersection point 156. The top-toe segment 140 may extend along the top side 112 of the toe portion 154 between the plane P1 and the toe-topline intersection point 156, and the top-heel segment 144 may extend along the top side 112 of the heel portion 160 between the plane P2 and the heel-topline inflection point 162. A toe periphery 170 defines a generally curved shape and may extend around the toe portion 154 from the toe-topline intersection point 156 to the toe-sole intersection point 158.

The sole 138 may extend along a periphery of the bottom side 114 from the toe-sole intersection point 158, along the sole portion 130 of the face insert 104, to the heel-sole intersection point 164. The sole-toe segment 148 may extend along the bottom side 114 of the toe portion 154 between the toe-sole intersection point 158 and the plane P1, and the sole-heel segment 152 may extend along the bottom side 114 of the heel portion 160 between the plane P2 and the heel-sole intersection point 164.

As described herein, the face insert 104 is arranged within the medial region 120. The face portion 128 is arranged on the front side 110 and defines a striking surface 172 that extends laterally in the heel-toe direction 136 between the planes P1 and P2 and vertically in the sole-topline direction 146 between the topline 134 and the sole 138. The striking surface 172 includes a plurality of grooves 174 formed therein that extend laterally in the heel-toe direction 136 along at least a portion of the striking surface 172. Each of the grooves 174 is spaced from an adjacent groove 174 in the sole-topline direction 146 (e.g., vertically spaced from the perspective of FIG. 4).

Figure 6:
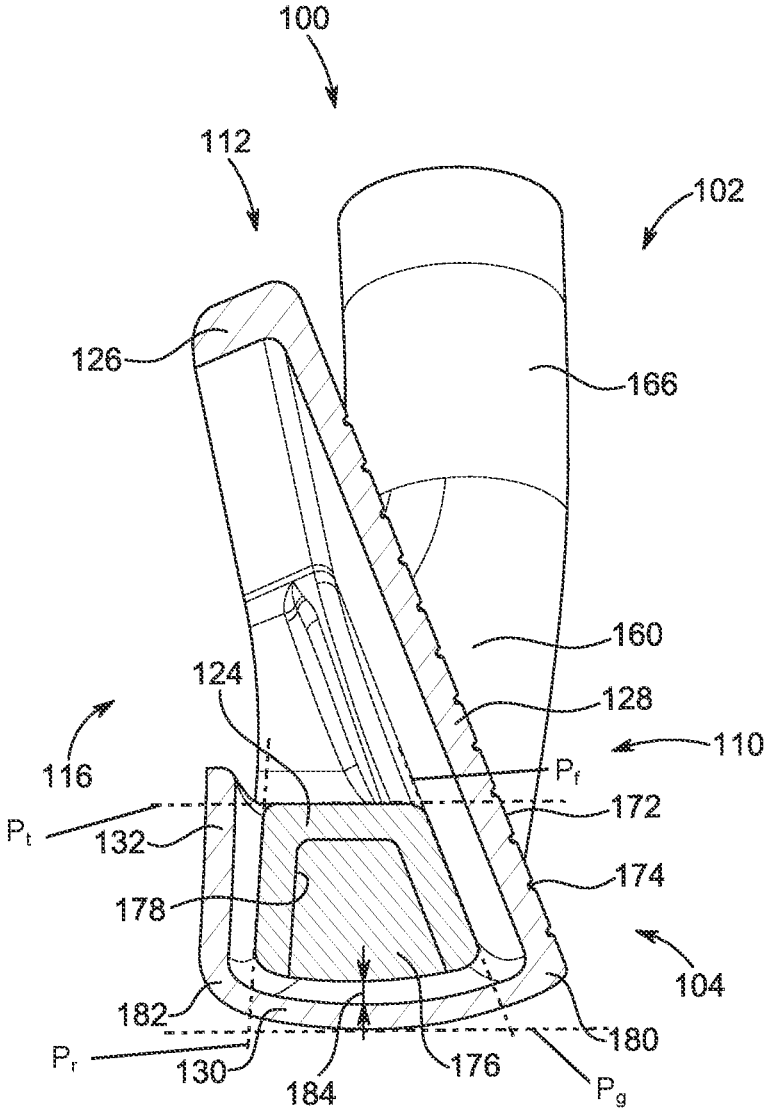
FIG. 6 is a cross-sectional view of the iron-type golf club head of FIG. 2 taken along line 6-6 of FIG. 4.
Figure 7:
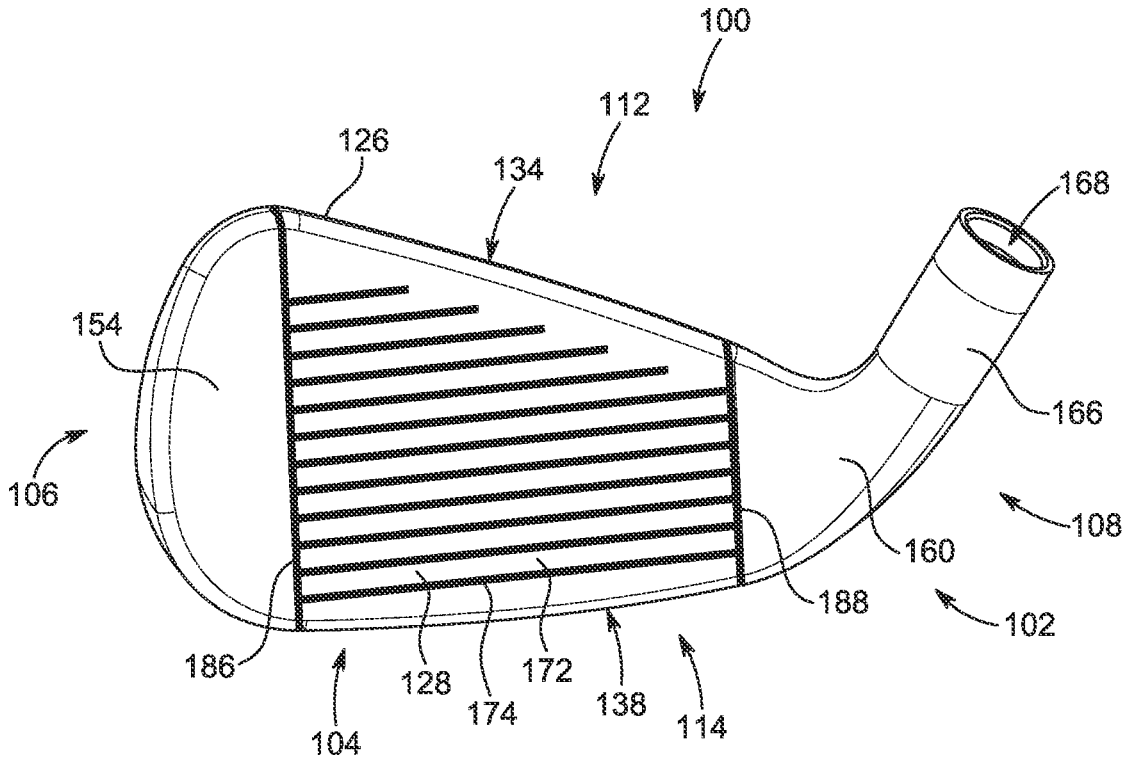
FIG. 7 is a top, front, right isometric view of the iron-type golf club head of FIG. 2 illustrating weld lines.
Figure 8:
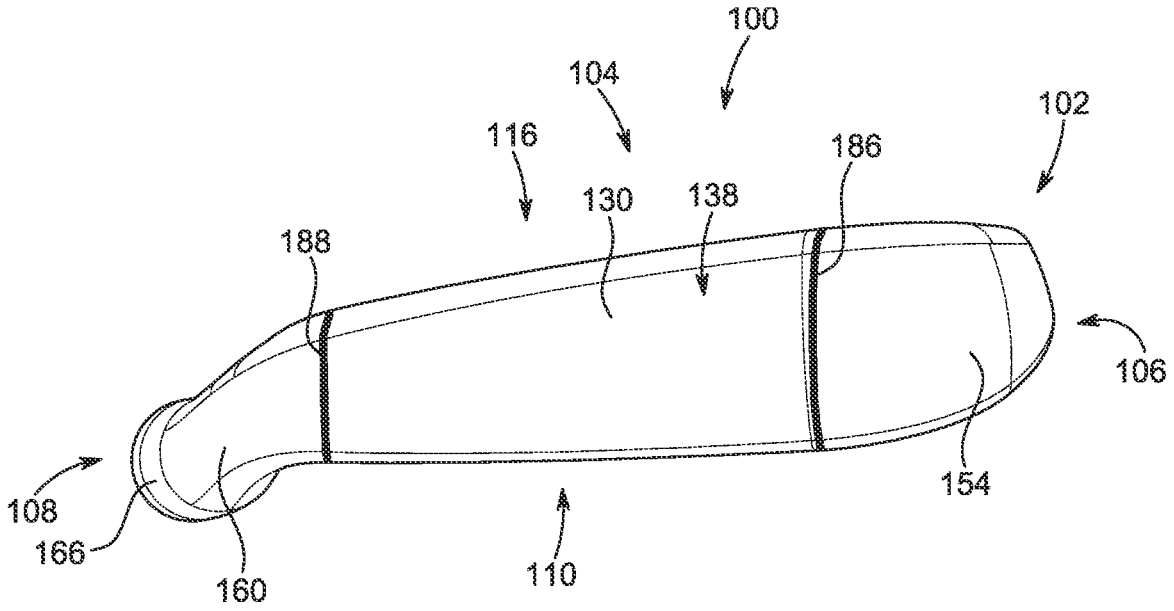
FIG. 8 is a top view of the iron-type golf club head of FIG. 2 illustrating weld lines.
Figure 9:
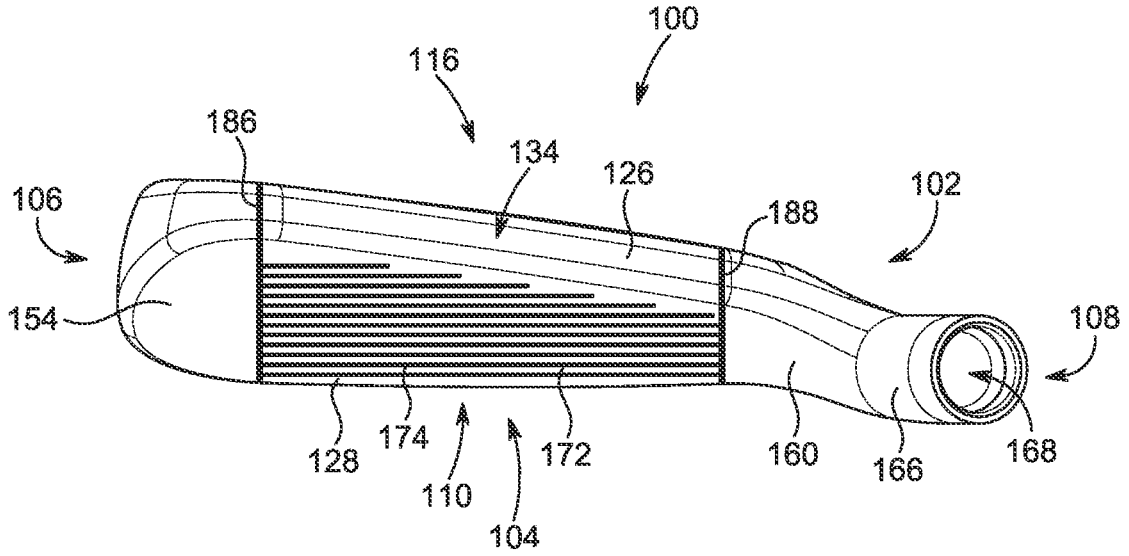
FIG. 9 is a bottom view of the iron-type golf club head of FIG. 2 illustrating weld lines.
Figure 10:
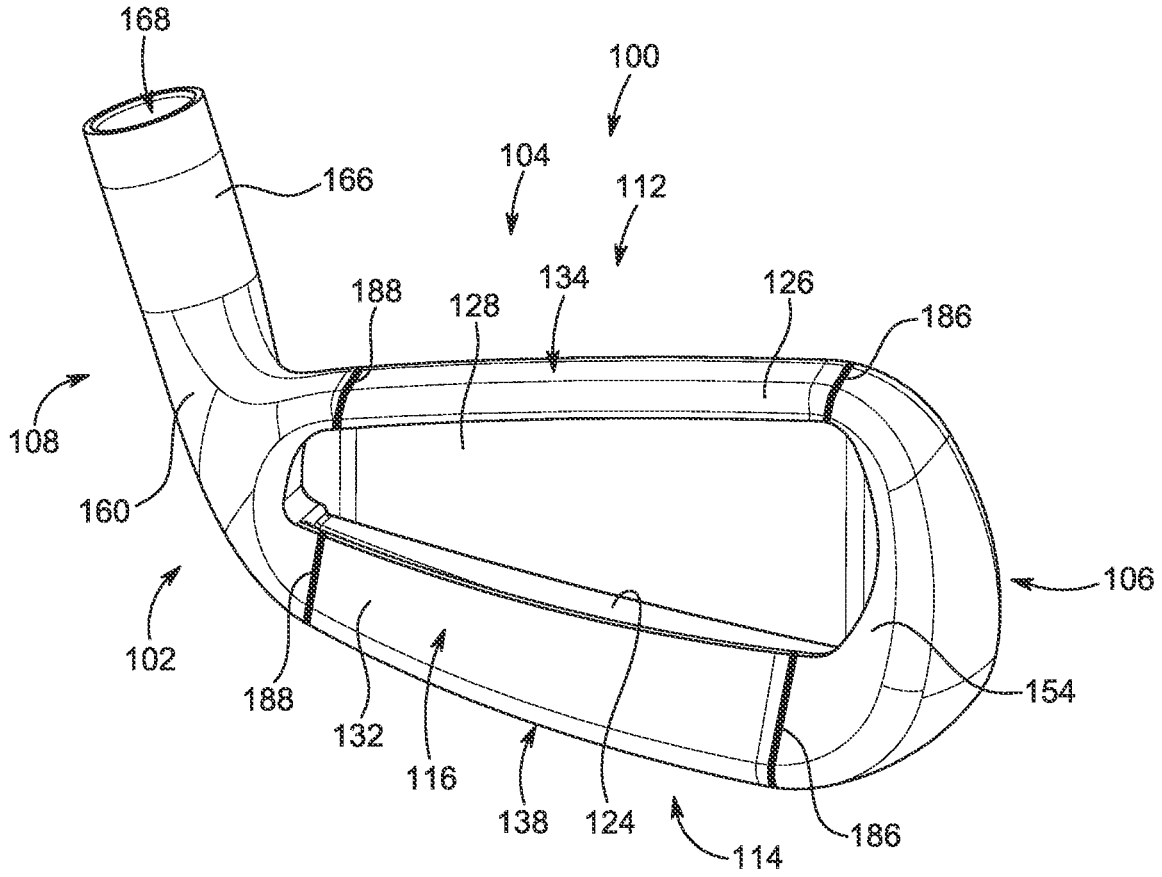
FIG. 10 is a top, back, right isometric view of the iron-type golf club head of FIG. 3 illustrating weld lines.

Referring now to FIGS. 1 and 6, the sole weight bar 124 includes a weight 176 that is received within a weight cavity 178 that is formed in the sole weight bar 124 and that extends laterally in the heel-toe direction 136 along the sole weight bar 124. The weight 176 may be fabricated from a higher density material than the material from which the body 102 is fabricated. In one embodiment, the weight 176 may be fabricated from a tungsten material. The weight 176 within the sole weight bar 124 is configured to lower a center of gravity defined by the iron-type golf club head 100, which aids in performance (e.g., higher launch angle).

With specific reference to FIG. 6, the face insert 104 may be formed as a unitary component (e.g., a single piece of material). The face portion 128 and the striking surface 172 are generally planar and are angled relative to a plane normal to the ground (not shown) on which the sole 138 may rest at address (e.g., a loft angle). This angle may be adjusted based on the type of iron (e.g., 2-iron, 7-iron, wedge, etc.) that the iron-type golf club head 100 is formed into. A rear plane Pr tangent to a first point on the rear face of the sole weight bar 124 is disposed at an angle relative to a front plane Pf tangent to a second point on the front face of the sole weight bar 124.

In the illustrated embodiment, the top portion 126 of the face insert 104 extends away from the face portion 128. Specifically, the top portion 126 extends from the top side 112 of the face portion 128 in a direction toward the rear side 116. In the illustrated embodiment, the top portion 126 extends toward the rear side 116 at a downward angle (e.g., angled toward the bottom side 114). At the bottom side 114 of the face portion 128, the sole portion 130 extends toward the rear side 116 to form a leading edge 180 arranged adjacent to the front side 110 to a trailing edge arranged adjacent to the rear side 116. In the illustrated embodiment, the sole portion 130 defines a generally rounded or curved shape. A top plane Pt is defined by a planar segment of the top face of the sole weight bar 124, and a sole face of the sole weight bar 124 is concavely curved relative to the top plane Pt. In addition, the sole face of the sole weight bar 124 and the sole portion 130 are convexly curved in a front-rear direction relative to a ground plane Pg.

The back portion 132 extends in a direction toward the top side 112 (e.g., upwardly from the perspective of FIG. 6) from the trailing edge 182 to a location between the top side 112 and the bottom side 114. In the illustrated embodiment, the back portion 132 extends toward the top side 112 a distance sufficient to cover the sole weight bar 124, when the iron-type golf club head 100 is viewed from the rear side 116 (see, e.g., FIG. 5).

In general, the geometry defined by the face insert 104 conforms to the geometry defined by the laterally-inner edges of the toe portion 154 and the heel portion 160. In this way, for example, when the face insert 104 is coupled to the body 102, the outer surfaces of the face insert 104 are arranged flush with the outer surfaces of the toe portion 154 and the heel portion 160 of the body 102.

As described herein, a section of the face portion 128 (e.g., adjacent to the bottom side 114), the sole portion 130, and the back portion 132 combine to form a generally U-shaped cavity that is designed to extend or wrap around the sole weight bar 124. In the illustrated embodiment, the face insert 104 extends around the sole weight bar 124, such that the face insert 104 is separated from the sole weight bar 124. That is, a gap 184 is formed between the sole portion 130 and the sole weight bar 124. In the illustrated embodiment, the gap 184 extends around an outer periphery of the sole weight bar 124 and is formed between the sole weight bar 124 and each of the face portion 128, the sole portion 130, and the back portion 132. The separation or gap 184 between the sole weight bar 124 and the face insert 104 keeps the center of gravity of the iron-type golf club head 100 low (e.g., in a direction toward the sole 138) and maintains the highest amount of flex possible in the face portion 128 and the sole 138, which improves club head performance (e.g., improved distance, accuracy, forgiveness, etc.).

The rear side 116 of the face insert 104 may be generally devoid of material, other than the top portion 126 and the back portion 132. In this way, for example, the iron-type golf club head 100 may define a generally open back cavity (e.g., a back cavity that is devoid of club head material), which further aids in lowering the center of gravity defined by the iron-type golf club head 100.

As described herein, the topline 134 and the sole 138 can be integrated into the face insert 104, which only requires welding in the sole-topline direction 146 at the interface between the face insert 104 and the body 102 to couple the face insert 104 to the body 102. Referring to FIGS. 7-10, the interface between the face insert 104 and the body 102 (highlighted using bold lines) is aligned entirely along the sole-topline direction 146. In the illustrated embodiment, the interface between the body 102 and the face insert 104 includes a first interface 186 between the laterally-inner edge of the toe portion 154 and the face insert 104 and a second interface 188 between the laterally-inner edge of the heel portion 160 and the face insert 104. Each of the first interface 186 and the second interface 188 is aligned along the sole-topline direction 146.

With the first interface 186 and the second interface 188 being aligned along the sole-topline direction 146, the iron-type golf club head 100 only requires welds along the sole-topline direction 146 to couple the face insert 104 to the body 102. For example, to manufacture the iron-type golf club head 100, the face insert 104 may be inserted into the medial region 120, such that the face insert 104 is flush with the toe portion 154 and the heel portion 160. Welding may then occur along the first interface 186 and the second interface 188 to couple the face insert 104 to the body 102.

The design and properties of the iron-type golf club head 100 provide several advantages over conventional iron-type golf club heads. For example, the lack of heel-toe direction 136 welds across the topline 134 and/or the sole 138 reduces a weld perimeter distance during manufacture, which results in weight being saved by having a shorter weld bead length. In addition, welding time is reduced, which results in manufacturing cost savings. Further, the ability to move the welds farther away from the impact location on the face portion 128 (e.g., the first interface 186 and the second interface 188 are arranged on the laterally-outer edges of the striking surface 172) provides greater control and tighter tolerances over the thickness of the face insert 104, especially in the high stress areas. Further still, the separation between the face insert 104 and the sole weight bar 124 allows for the maximum possible amount of face and sole flexibility. Each of these advantages drive performance increases for the iron-type golf club head 100 over conventional iron-type golf club heads.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. An iron-type golf club head, comprising: a body including a toe region and a heel region, the toe region and the heel region each defining a portion of a top line and a portion of a sole of the iron-type golf club head; a sole weight bar extending between the toe region and the heel region; and a face insert that is coupled to the body and wraps about the sole weight bar, wherein the sole defines a toe segment, a medial segment, and a heel segment, the face insert at least partially defining the medial segment of the sole, wherein a gap is disposed between the sole weight bar and the face insert, wherein the gap extends entirely about an outer periphery of the sole weight bar and is disposed between the sole weight bar and each of a face portion of the face insert, a sole portion of the face insert, and a back portion of the body, wherein the gap defines: a first thickness between the face portion of the face insert and a first face of the sole weight bar; and a second thickness between the back portion of the body and a second face of the sole weight bar, and wherein the first thickness and the second thickness are each less than a thickness of the sole weight bar measured between the first face and the second face along a front-rear direction.

2. The iron-type golf club head of claim 1, wherein a weight is disposed within a weight cavity of the sole weight bar.

3. The iron-type golf club head of claim 1, wherein the body and the sole weight bar comprise different materials.

4. The iron-type golf club head of claim 1, wherein the sole weight bar is coupled to the body at a first location within the toe region and at a second location within the heel region.

5. The iron-type golf club head of claim 1, wherein the gap includes:

a front gap defined between the face portion and a front face of the sole weight bar; and a rear gap defined between the back portion and a rear face of the sole weight bar.

6. The iron-type golf club head of claim 1, wherein the face portion, the sole portion, and the back portion define a U-shaped cavity that extends entirely about the sole weight bar.

7. The iron-type golf club head of claim 1, wherein the sole weight bar is positioned entirely below a geometric center point of the face portion of the face insert.

8. An iron-type golf club head, comprising:

a body including a toe region and a heel region, the toe region and the heel region each defining a portion of a top line and a portion of a sole of the iron-type golf club head;

a sole weight bar extending between the toe region and the heel region; and a face insert coupled to the body and including a face portion and a sole portion that wrap around the sole weight bar, wherein a gap is disposed between the sole weight bar and the face insert, wherein the gap extends entirely about an outer periphery of the sole weight bar and is disposed between the sole weight bar and each of the face portion, the sole portion, and a back portion of the body, wherein the gap defines:

a first thickness between the face portion of the face insert and a first face of the sole weight bar; and a second thickness between the back portion of the body and a second face of the sole weight bar, and wherein the first thickness and the second thickness are each less than a thickness of the sole weight bar measured between the first face and the second face along a front-rear direction.

9. The iron-type golf club head of claim 8, wherein a weight is disposed within a weight cavity of the sole weight bar.

10. The iron-type golf club head of claim 9, wherein the weight comprises a higher density material than a material of the body.

11. The iron-type golf club head of claim 8, wherein the sole weight bar is coupled to the body at a first location within the toe region and at a second location within the heel region.

12. The iron-type golf club head of claim 8, wherein the sole weight bar comprises a front face and a rear face, and wherein an acute angle is defined between a first point on the front face and a second point on the rear face.

13. The iron-type golf club head of claim 8, wherein the face portion, the sole portion, and the back portion define a U-shaped cavity that extends entirely about the sole weight bar.

14. The iron-type golf club head of claim 8, wherein the sole defines a toe segment, a medial segment, and a heel segment, wherein the sole portion of the face insert at least partially defines the medial segment of the sole.

15. An iron-type golf club head, comprising: a body including a toe region and a heel region, the toe region and the heel region each defining a portion of a top line and a portion of a sole of the iron-type golf club head; a sole weight bar extending between the toe region and the heel region; and a face insert coupled to the body at an interface between the face insert and the body, wherein the sole defines a toe segment, a medial segment, and a heel segment, wherein the face insert includes a face portion and a sole portion that wrap around the sole weight bar, the sole portion at least partially defining the medial segment of the sole, wherein a gap is disposed between the sole weight bar and the face insert, wherein the gap extends entirely about an outer periphery of the sole weight bar and is disposed between the sole weight bar and each of the face portion, the sole portion, and a back portion of the body, wherein the gap defines: a first thickness between the face portion of the face insert and a first face of the sole weight bar; and a second thickness between the back portion of the body and a second face of the sole weight bar, and wherein the first thickness and the second thickness are each less than a thickness of the sole weight bar measured between the first face and the second face along a front-rear direction.

16. The iron-type golf club head of claim 15, wherein the sole weight bar is positioned entirely below a geometric center point of the face portion of the face insert, and wherein a weight is disposed within a weight cavity of the sole weight bar.

17. The iron-type golf club head of claim 16, wherein the body and the weight comprise different materials.

18. The iron-type golf club head of claim 15, wherein the body defines a medial region, and wherein the sole weight bar extends through the medial region.

19. The iron-type golf club head of claim 15, wherein the sole weight bar is coupled to the body at a first location within the toe region and at a second location within the heel region.

20. The iron-type golf club head of claim 15, wherein a sole surface of the sole weight bar and the sole portion are convexly curved in the front-rear direction relative to a ground plane.

* * * * *